US011066801B2

(12) United States Patent
Rivest-Auger et al.

(10) Patent No.: US 11,066,801 B2
(45) Date of Patent: Jul. 20, 2021

(54) COFFERDAM SYSTEM AND METHOD OF INSTALLING THE SAME

(71) Applicant: AQUAPERA INDUSTRIES INC., Prevost (CA)

(72) Inventors: Nicolas Rivest-Auger, Sainte Anne des Lacs (CA); Louis-Philippe Plante, St-Lin-Laurentides (CA)

(73) Assignee: AQUAPERA INDUSTRIES INC., Quebec (CA)

( * ) Notice: Subject to any disclaimer, the term of this patent is extended or adjusted under 35 U.S.C. 154(b) by 0 days.

(21) Appl. No.: 16/685,684

(22) Filed: Nov. 15, 2019

(65) Prior Publication Data

US 2020/0157758 A1 May 21, 2020

Related U.S. Application Data

(60) Provisional application No. 62/767,614, filed on Nov. 15, 2018.

(51) Int. Cl.
*E02D 23/00* (2006.01)
*E02D 25/00* (2006.01)
*E02D 19/04* (2006.01)

(52) U.S. Cl.
CPC ..... *E02D 19/04* (2013.01); *E02D 2250/0061* (2013.01)

(58) Field of Classification Search
CPC . E02D 19/04; E02D 2250/0061; E02D 23/00; E02D 25/00; B63B 17/0018
USPC ..... 405/11–14
See application file for complete search history.

(56) References Cited

U.S. PATENT DOCUMENTS 3,380,255 A * 4/1968 Schroeder, Jr. ..... E02D 19/04 405/11
3,435,793 A * 4/1969 Shurtleff ..... B65D 88/78 114/257
3,438,204 A * 4/1969 Cleary ..... B65D 88/78 405/210
3,619,042 A * 11/1971 Lazar ..... G02B 23/22 359/895
3,648,990 A * 3/1972 Stoker ..... E04H 5/12 261/109

(Continued)

*Primary Examiner* — Edwin J Toledo-Duran
(74) *Attorney, Agent, or Firm* — Hunton Andrews Kurth LLP

(57) ABSTRACT

The present disclosure relates to a cofferdam system securable to an underwater structure and across a body of water. The system includes a post support and anchoring assembly securable to the structure, a web support frame which extends upwardly from the post support and anchoring assembly in a spaced apart configuration from a surface defined by the underwater structure, as well as a substantially flexible impermeable web which is positioned across the body of water and which is adapted to cover the post support and anchoring assembly and at least a lower section of the web support frame outwardly therefrom. Such configuration of the system allows to provide a substantially dry enclosure from a dam upstream side between the substantially flexible impermeable web and the underwater structure when mounted thereto and once water is being removed from a dam downstream side. A method for installing the same is further described.

18 Claims, 9 Drawing Sheets

(56) References Cited

U.S. PATENT DOCUMENTS 3,800,542 A * 4/1974 Cerasari ..... E02B 15/0885 405/72
3,879,951 A * 4/1975 Mason ..... E21B 43/0122 405/60
4,104,906 A * 8/1978 Oertle ..... G01L 1/22 116/70
4,136,995 A * 1/1979 Fish ..... E02B 7/005 405/115
4,373,834 A * 2/1983 Grace ..... E21B 43/0122 405/209
4,475,535 A * 10/1984 Assaf ..... F24S 10/13 126/568
4,606,674 A * 8/1986 Capron ..... B63B 35/44 405/195.1
4,610,794 A * 9/1986 Tsahalis ..... E02B 15/06 210/776
4,906,134 A * 3/1990 Hoyeck ..... E02B 7/005 405/107
4,921,373 A * 5/1990 Coffey ..... E02B 3/108 256/13
6,079,904 A * 6/2000 Trisl ..... E02B 3/106 405/107
6,126,362 A * 10/2000 Carter ..... E02B 3/108 405/114
6,554,534 B1 * 4/2003 Butterfield ..... E02B 15/0814 405/63
6,676,333 B2 * 1/2004 Wiseman ..... E02B 3/106 405/114
7,574,834 B2 * 8/2009 Murray ..... A62C 99/00 249/159
2002/0133983 A1 * 9/2002 Chesner ..... B09C 1/00 37/307
2011/0155036 A1 * 6/2011 Bowhay ..... B63B 35/44 114/256
2013/0020331 A1 * 1/2013 Davis ..... E02B 3/10 220/565
2016/0264267 A1 * 9/2016 Rygaard ..... B64G 1/66

* cited by examiner

COFFERDAM SYSTEM AND METHOD OF INSTALLING THE SAME

CROSS-REFERENCE TO RELATED APPLICATIONS

This application claims priority from U.S. Provisional Application No. 62/767,614 filed on Nov. 15, 2018, which is hereby incorporated by reference.

TECHNICAL FIELD

The present disclosure relates to the field of cofferdam systems and methods of installing the same. More particularly, the present disclosure relates to easy to install cofferdam systems that provide a temporary dam for waterways, watercourses and the like.

BACKGROUND

A cofferdam, or coffer, is an enclosure that is built within, or in pairs across, a body of water, a waterway or a watercourse for example, to allow water found in the enclosed area to be pumped out such as to provide a substantially dry environment. Such pumping creates a dry work environment for the work to be carried out. Enclosed coffers are commonly used for construction or repair of permanent dams, oil platforms, bridge piers, etc., built within or over water.

Known cofferdam systems usually include a main frame made of a plurality of support posts that is configured so as to be anchored to the bed of the waterway or watercourse, as well as a flexible impermeable web that is secured to and that covers, at least in part, the main frame. Therefore, to operate the system in a waterway which is full of water, the main frame is first secured to the bed of the waterway. Second, the flexible impermeable web is draped across the waterway and above the main frame. When the skirt of the flexible impermeable web is resting on the bed of the waterway, pumping is provided to remove water from the downstream side of the dam, thereby establishing a pressure differential between the two surfaces of the flexible impermeable web.

Even if some of these systems are simple to install, they are self-supportive, meaning that if the bed of the waterway or watercourse is too low or alternatively, uneven, it cannot be used to provide the desired enclosed area from which water will be pumped out.

Other systems are often found to be heavy but also not easy to install nor to transport. Furthermore, such systems are more than often manufactured/customized to meet the specifications of one site only and thus, cannot be re-used according to the specifications of a different site (of a different structure, wall, etc. to be built, repaired, restored and/or accessed). Such systems are usually dismantled and not re-used after the construction work is completed.

There is therefore a need for an improved cofferdam system and to an improved method of installing the same that can provide a proper dry environment for workers, even if the waterway or watercourse bed is found to be too low, or uneven, to receive a self-supported cofferdam system.

SUMMARY

In accordance with an embodiment, there is provided a cofferdam system securable to an underwater structure defining an underwater structure surface and across a body of water defining a dam downstream side and a dam upstream side, the cofferdam system comprising: a post support and anchoring assembly securable to the underwater structure; a web support frame extending at least partially upwardly from the post support and anchoring assembly in a spaced apart configuration from the underwater structure surface; and a substantially flexible impermeable web positioned across the body of water and configured to cover the post support and anchoring assembly and at least a lower section of the web support frame outwardly therefrom to provide a substantially dry enclosure from the dam upstream side between the substantially flexible impermeable web and the underwater structure surface when mounted to the underwater structure and once water is being removed from the dam downstream side.

In some implementations, the post support and anchoring assembly comprises an anchoring portion securable to the underwater structure and a post support portion releasably mounted to the anchoring portion and engageable with the web support frame to support the same.

In some implementations, the post support portion comprises a plurality of spaced apart post receiving members with the web support frame being securable thereto in the spaced apart configuration from the underwater structure surface.

In some implementations, the anchoring portion comprises an upper mounting element securable to the underwater structure and engageable with an upper portion of the post support portion to mount the post support portion to the underwater structure and a lower mounting element securable to the underwater structure at a distance from the upper mounting element and engageable with a lower portion of the post support portion to mount the post support portion to the underwater structure.

In some implementations, the post support portion comprises a plurality of spaced apart post support trusses being releasably securable to the anchoring portion, each one of the post support trusses comprising at least one of the plurality of spaced apart post receiving members with the post receiving members being engageable by the web support frame in the spaced apart configuration from the underwater structure surface.

In some implementations, the upper mounting element comprises a plurality of aligned elongated anchoring bars, each one of the elongated anchoring bars comprising an anchoring segment superposable to the underwater structure surface and securable to the underwater structure and a post support structure receiving segment extending from the anchoring segment with the post support structure receiving segment being engageable by the upper portion of the post support portion.

In some implementations, the lower mounting element comprises a plurality of spaced apart anchoring plates superposable to the underwater structure surface and securable to the underwater structure, each one of the anchoring plates having an external surface and comprising an anchoring plate connector protruding therefrom, the bottom portion of the post support portion being releasably securable to the anchoring plate connector.

In some implementations, each one of the post support trusses comprises an underwater structure link comprising: an upper mounting element connector releasably engageable with the upper mounting element; a lower mounting element connector spaced-apart vertically from the upper mounting element connector and releasably engageable with the lower mounting element; and a vertically extending post extending therebetween.

In some implementations, the upper and lower mounting element connectors are respectively pivotally engageable with the post support structure receiving segment of a respective one of the plurality of aligned elongated anchoring bars and the anchoring plate connector protruding from a respective one of the plurality of spaced apart anchoring plates.

In some implementations, the web support frame comprises a set of vertically oriented elongated support posts, each one of the vertically oriented elongated support posts being releasably securable to a respective one of the plurality of spaced apart post receiving members.

In some implementations, the web support frame further comprises a set of horizontally oriented elongated support posts, each one of the horizontally oriented elongated support posts extending perpendicularly from the set of vertically oriented elongated support posts to form a grid configuration to support the flexible impermeable web from the dam upstream side as water applies pressure towards the flexible impermeable web.

In some implementations, each one of the post support trusses further comprises a top chord and a bottom chord, each one of the top and bottom chords extending from the underwater structure surface when mounted thereto and defining an underwater structure end adjacent to the underwater structure surface and an opposed support post end spaced apart from the underwater structure surface when mounted to the underwater structure.

In some implementations, the top cord extends substantially normal to the vertically extending post and the bottom chord extends diagonally upwardly from the vertically extending post towards the support post end of the top cord.

In some implementations, the support post ends of the top and bottom chords are connected to one another by a respective one of the plurality of post receiving members, the post receiving member having a post receiving channel extending substantially vertically therein to receive at least a respective one of the vertically oriented elongated support posts therein.

In some implementations, the plurality of aligned elongated anchoring bars are securable to the underwater structure in an horizontally adjacent configuration and the plurality of spaced apart anchoring plates are securable to the underwater structure below the plurality of aligned elongated anchoring bars in a configuration substantially parallel to the anchoring bars.

In some implementations, the anchoring plate connector comprises two plates spaced-apart from one another to define a spacing inbetween to receive the lower mounting element connector therein in a pivotable engagement about a pivot axis extending parallel to the underwater structure link when secured together.

In accordance with another embodiment, there is provided a method for forming a substantially dry enclosure adjacent an underwater structure defining an underwater structure surface and within a body of water defining a dam downstream side and a dam upstream side, the method comprising: securing a post support and anchoring assembly to the underwater structure; providing a web support frame to extend at least partially upwardly from the post support and anchoring assembly in a spaced apart configuration from the underwater structure surface; positioning a substantially flexible impermeable web across the body of water so as to cover the post support and anchoring assembly and at least a lower section of the web support frame with the substantially flexible impermeable web from the dam upstream side; and pumping water out of the dam downstream side to provide the substantially dry enclosure from the dam upstream side between the substantially flexible impermeable web and the underwater structure.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

DETAILED DESCRIPTION

In the following description, the same numerical references refer to similar elements. Furthermore, for the sake of simplicity and clarity, namely so as to not unduly burden the figures with several reference numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures or described in the present disclosure are embodiments only, given solely for exemplification purposes.

Moreover, although the embodiments of the cofferdam system and corresponding parts thereof consist of certain geometrical configurations as explained and illustrated herein, not all of these components and geometries are needed and thus should not be taken in their restrictive sense. It is to be understood, as also apparent to a person skilled in the art, that other suitable components and cooperation thereinbetween, as well as other suitable geometrical configurations, may be used for such cofferdam system, as will be briefly explained herein and as can be easily inferred herefrom by a person skilled in the art. It will also be appreciated that positional descriptions such as "upper", "lower", "left", "right" and the like should, unless otherwise indicated, be taken in the context of the figures and correspond to the position and orientation of the cofferdam system and corresponding parts shown in the Figures. Positional descriptions should therefore not be considered limiting.

To provide a more concise description, some of the quantitative and qualitative expressions given herein may be qualified with the terms "about" and "substantially". It is understood that whether the terms "about" and "substantially" are used explicitly or not, every quantity or qualification given herein is meant to refer to an actual given value or qualification, and it is also meant to refer to the approximation to such given value or qualification that would reasonably be inferred based on the ordinary skill in the art, including approximations due to the experimental and/or measurement conditions for such given value.

The present disclosure relates to cofferdam systems that are configured to be directly mounted or secured to an underwater structure that needs to be reached for reparation for example, and that are adapted to provide temporary dams for waterways or watercourses such as rivers, canals, estuaries, lakes, seas, oceans, or any body of water.

Figure 1:
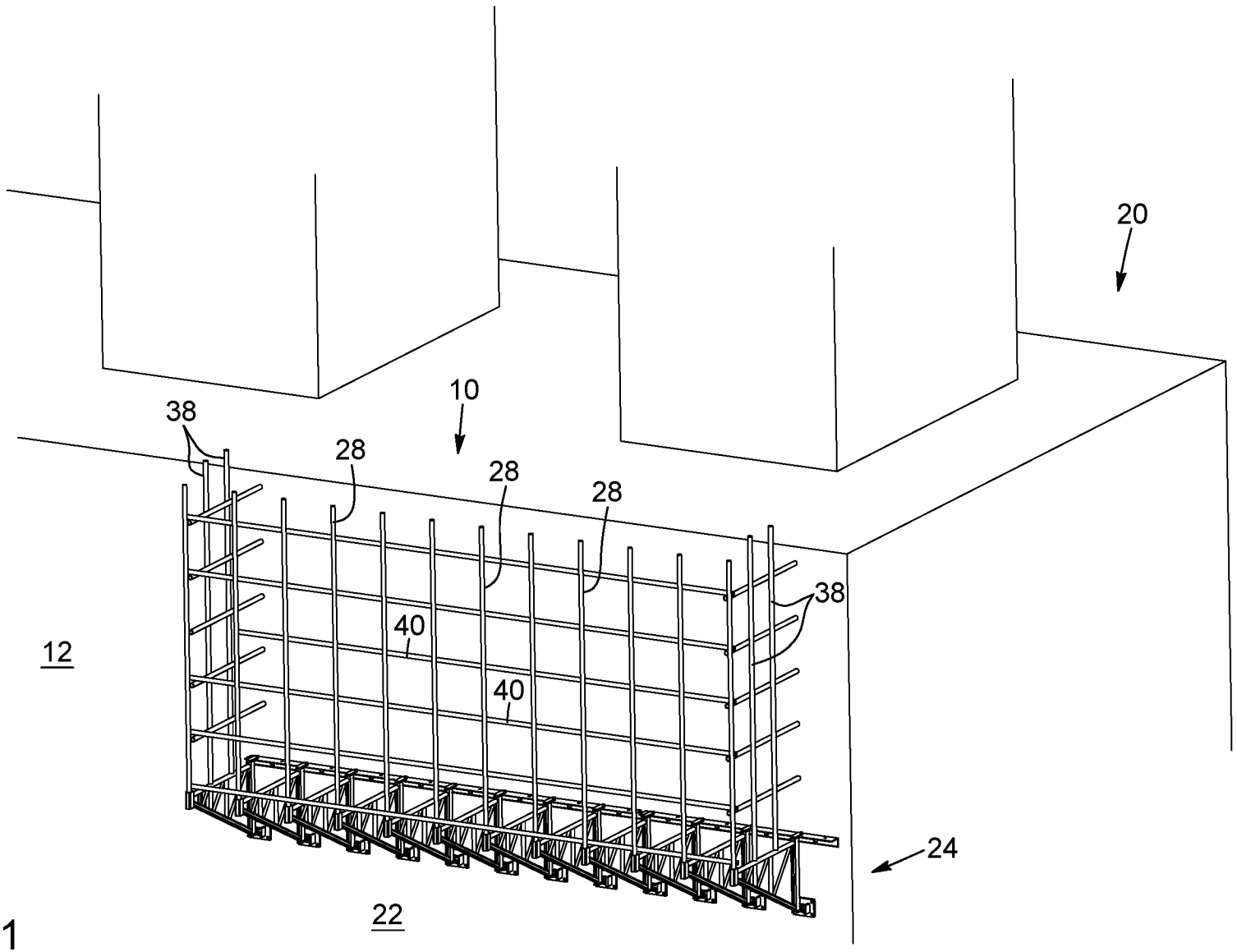
FIG. 1 is a top perspective view of a cofferdam system which is anchored or secured to an underwater structure in accordance with an embodiment.
Figure 2:
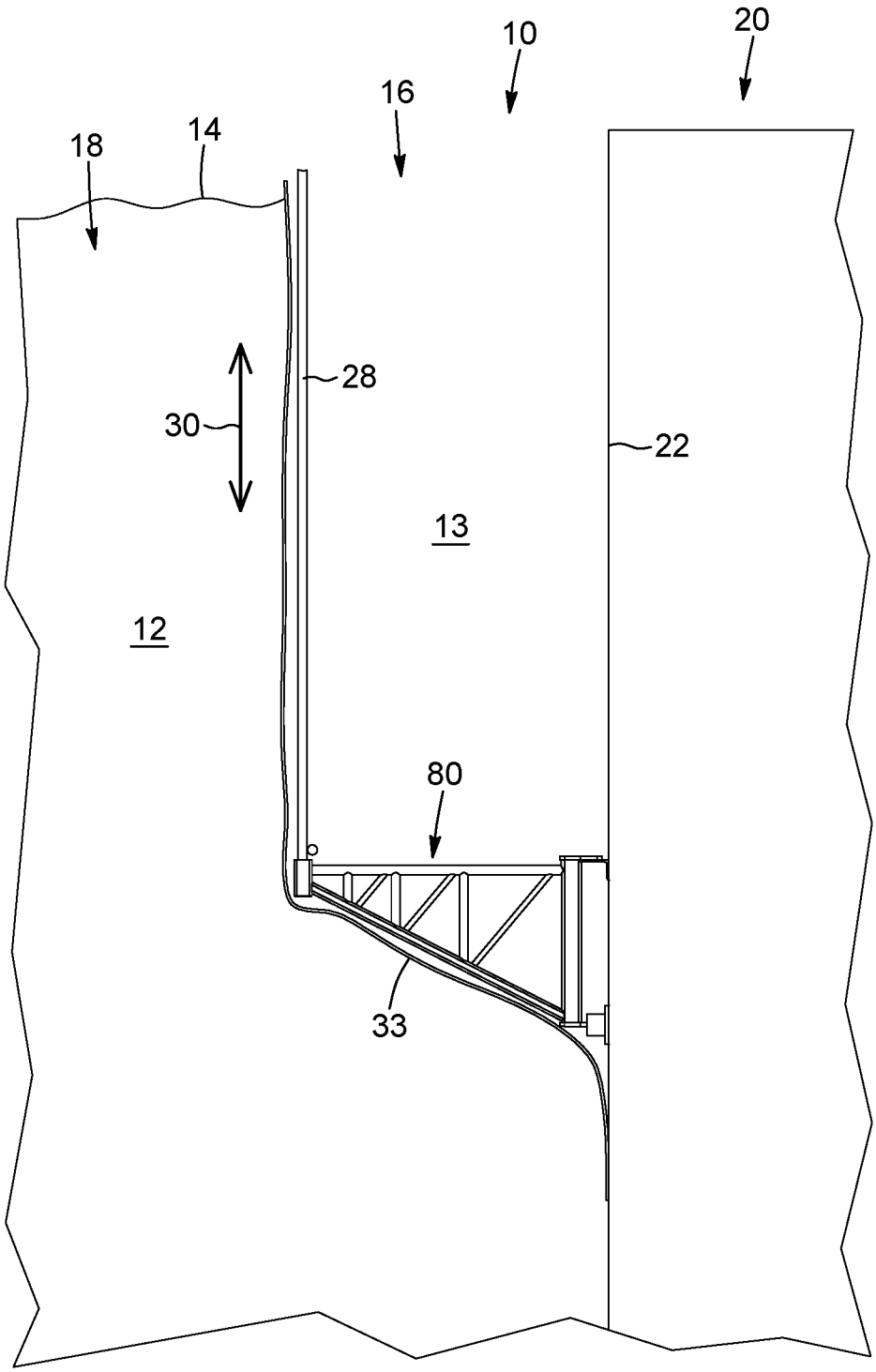
FIG. 2 is a side elevation view of the cofferdam system of FIG. 1.
Figure 3:
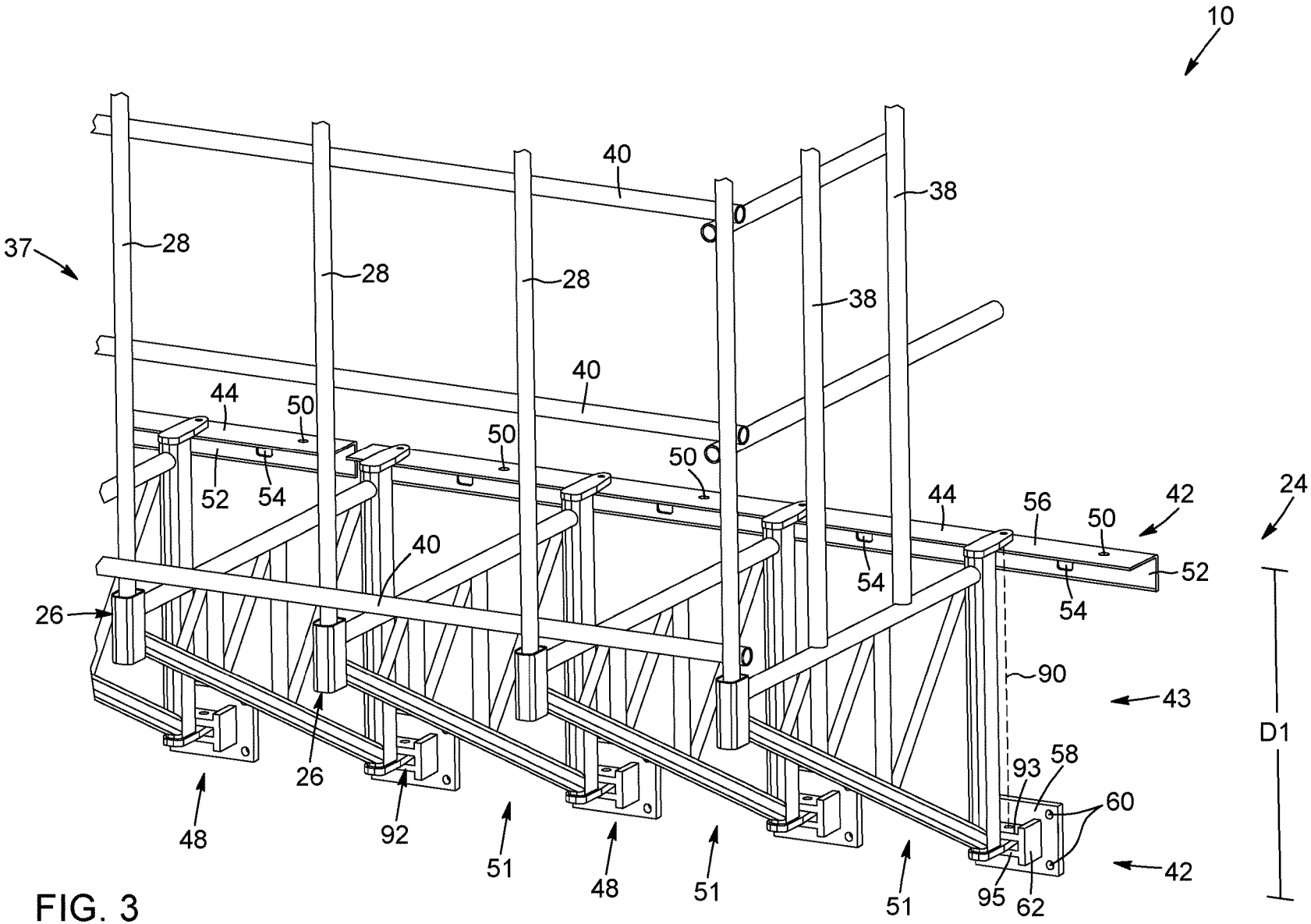
FIG. 3 is a closed-up perspective view of the cofferdam system of FIG. 1.

Referring now to the drawings and more particularly to the non-limitative embodiment shown in FIGS. 1 to 3, there is provided a cofferdam system 10 which is configured to be installed in a body of water 12, such as a waterway, watercourse, etc., for providing a substantially dry enclosure or environment 13, a substantially dry working environment for instance. Body of water 12 defines a water surface 14 (FIG. 2), a dam downstream side 16, which corresponds to the substantially dry environment 13 once the water has been pumped out, and a dam upstream side 18. As best illustrated in the non-limitative embodiment shown in FIGS. 2 and 3, the cofferdam system 10 is anchored, mounted or secured to an underwater structure 20 which defines an underwater structure surface 22. Even though the underwater structure 20 is illustrated as being an underwater bridge footing (FIG. 1), a person skilled in the art to which the cofferdam system 10 pertains would understand that the underwater structure 20 can be characterized by any structure that is totally or partly located underwater and that needs to be built, rebuilt, repaired and/or simply reached. Furthermore, even though the underwater structure 20 is being illustrated as defining only one underwater structure surface 22 (provided on one plan only) on which the system is being installed, it is noted that the surface to be built, rebuilt, repaired and/or simply reached can define one or more surface(s) (one or more plan(s)) of any shape, size and/or configuration. Therefore, the cofferdam system 10 can be anchored or secured to the underwater structure such as to circumscribe 360° of a bridge footing defining four perpendicular faces, each face being perpendicular to its adjacent faces (as shown in the non-limitative embodiment of FIG. 7 for example). It is further noted that the underwater structure surface 22 can be substantially perpendicular to water surface 14 (i.e., underwater structure surface 22 can be substantially vertical), but the cofferdam system 10 can be suited to accommodate any underwater structure surface.

As shown in the non-limitative embodiment of FIGS. 1 to 3, the cofferdam system 10 comprises a post support and anchoring assembly 24 which is configured to be anchored or secured to the underwater structure 20 or the underwater structure surface 22 and which is further configured to support a web support frame 37 in a spaced apart configuration from the underwater structure surface 22. As will be described in more details below, the web support frame 37 extends at least partially upwardly from the post support and anchoring assembly 24. Indeed, the post support and anchoring assembly 24 includes a plurality of spaced apart post receiving members 26 for securing the web support frame 37 therein, while providing the web support frame 37 spaced apart from the underwater structure surface 22. The web support frame 37 of the cofferdam system 10 includes a set of elongated support posts 28. Each one of the elongated support posts 28 is being releasably secured in a corresponding one of the spaced apart post receiving members 26, in a substantially perpendicular orientation with respect to the water surface 14, and in some implementations, parallel to the underwater structure surface 22. In the non-limitative embodiment shown, the elongated support posts 28 extend upwardly from the post receiving members 26.

The cofferdam system 10 further includes a substantially flexible impermeable web 33 (FIG. 2) which is positioned across the body of water 12. Flexible impermeable web 33 covers the post support and anchoring assembly 24 and the web support frame 37 which includes the plurality of elongated support posts 28 (or covers at least a lower section of the web support frame 37 or a lower section of the plurality of vertically oriented elongated support posts 28) from the dam upstream side 18. Such configuration of the cofferdam system 10 allows to pump water out of the formed enclosure 13, from the dam downstream side 16, such as to provide a substantially dry working environment from the dam upstream side 18, between the substantially flexible impermeable web 33 and the underwater structure 20 or the underwater structure surface 22.

Still referring to the non-limitative embodiment shown in FIGS. 1 to 3, the post support and anchoring assembly 24 includes an anchoring portion 42 to be mounted and secured to the underwater structure 20, as well as a post support portion 43, to support the post receiving members 26 in a spaced apart configuration from the anchoring portion 42 and the underwater structure 20. As will be described in more details below, the post support portion 43 is releasably mounted to the anchoring portion 42. The anchoring portion 42 has upper mounting element(s) 44 to be anchored to the underwater structure surface 22 and lower mounting element(s) 48 to be anchored to the underwater structure surface 22, at a distance D1 from the upper mounting element(s) 44 (below the upper mounting element(s) 44 in the non-limitative embodiment shown in FIGS. 1 to 3).

Therefore, when the cofferdam system 10 is being installed in the body of water 12, by a skilled diver for instance, the post support and anchoring assembly 24 is being mounted and secured to the underwater structure 20. Each one of the elongated support posts 28 of the web support frame 37 is releasably secured to (or within) a corresponding one of the post receiving members 26. The substantially flexible impermeable web 33 is then positioned across the body of water 12 and mounted to the post support and anchoring assembly 24 and to at least a lower portion of the web support frame 37, outwardly thereof, so as to provide the substantially dry working area 13. Alternatively, the flexible impermeable web 33 can be secured to the structure 20 and/or the bed of the waterway.

It is noted that more than one substantially flexible impermeable webs 33 can be outwardly provided to cover the post support and anchoring assembly 24 as well as at least a lower section of the web support frame 37 in a watertight manner. To secure the flexible impermeable web 33, an upper longitudinal edge of the flexible impermeable web 33 can be engaged with or secured to upper ends of the elongated support posts 28 (or to an upper portion of the web support frame 37), while a skirt or lower longitudinal edge of the substantially flexible impermeable web 33 can be secured at a waterway bottom surface using one or more weights (e.g., sand bags, cement blocks, etc.) positioned along the length of the lower longitudinal edge of the substantially flexible impermeable web 33. Additional anchors (not shown) can additionally, or alternatively, be mounted to the underwater structure surface 22 to strongly secure flexible impermeable web 33 to the underwater structure 20, as water applies pressure to the flexible impermeable web 33, the post support and anchoring assembly 24 as well as the web support frame 37.

The substantially flexible impermeable web 33 can be a geotextile, or alternatively, be made of a reinforced PVC and can be of a construction similar to a nylon reinforced PVC tarpaulin. The upper longitudinal edge of the substantially flexible impermeable web 33 can include a plurality of loops or other suitable connectors (not shown) secured thereto at uniformly spaced intervals along its length. The flexible impermeable web 33 can thus be secured to the post support and anchoring assembly 24 between its upper and lower edges.

Still referring to the non-limitative embodiment shown in FIGS. 1 to 3, the web support frame 37 of the cofferdam system 10 further includes a plurality of elongated support posts 40 that extend perpendicularly and that are releasably secured to the vertically oriented elongated support posts 28. Elongated support posts 40 are found to be in a substantially parallel orientation with respect to the water surface 14 (i.e., posts 40 are horizontally positioned, while posts 28 are vertically positioned). As well illustrated, support posts 28, 40 extend substantially perpendicularly to form a grid configuration to support the flexible impermeable web 33. Each elongated support post 40 can be releasably secured to the corresponding vertically oriented elongated support posts 28 using pipe clamps for example, or any other suitable mechanisms.

Still referring to the non-limitative embodiment shown in FIGS. 1 to 3, upper mounting element(s) 44 include a plurality of aligned elongated anchoring bars 44. Each elongated anchoring bar 44 defines an anchoring segment 52 superposable to the underwater structure surface 22 and a post support structure receiving segment 56 which extends substantially perpendicularly from the anchoring segment 52. Furthermore, each one of the elongated anchoring bars 44 includes a plurality of spaced apart mounting apertures 54 defined in anchoring segment 52 which are adapted to anchor the elongated anchoring bars 44 to the underwater structure 20 using suitable mechanical fasteners or connectors insertable therein. Each one of the elongated anchoring bars 44 further includes a plurality of spaced apart post support portion receiving apertures 50 defined in post support structure receiving segment 56 for mounting the post support portion 43 thereon, as it will be described in more details below.

On the other hand, the lower mounting elements 48 include a plurality of spaced apart anchoring plates 58, each one having an anchoring plate connector 62 extending forwardly from an external surface of the anchoring plate 58 which is configured to releasably receive and engage a bottom portion of the post support portion 43. The anchoring plates 58 are superposed to the underwater structure surface 22. Each anchoring plate 58 includes a plurality of anchoring plate apertures 60 which are adapted to secure the anchor anchoring plate 58 to the underwater structure 20 using suitable mechanical fasteners or connectors insertable therein.

Elongated anchoring bars 44 are mounted to the underwater structure 20 adjacent the one another along a substantially horizontal axis, while anchoring plates 58 are mounted to underwater structure 20, below anchoring bars 44, also along a substantially horizontal axis (such that both axis are substantially parallel to the water surface 14) but in a spaced-apart configuration.

Still referring to the non-limitative embodiment shown in FIGS. 1 to 3, the post support portion 43 includes a plurality of spaced apart post support trusses 51. Each post support truss 51 is releasably connected to a corresponding one of the plurality of elongated anchoring bars 44 and further, to a corresponding one of the plurality of spaced apart anchoring plate connectors 62, such that each post support truss 51 is oriented in a substantially perpendicular orientation with respect to the water surface 14 and to the underwater structure surface 22. Indeed, such orientation will allow the elongated posts 28 of the web support frame 37, once introduced and secured into the post receiving members 26 of the posts support portion 43, to also be positioned in a substantially perpendicular orientation with respect to the water surface 14, while spaced apart from the underwater structure 20 or underwater structure surface 22.

Figure 4:
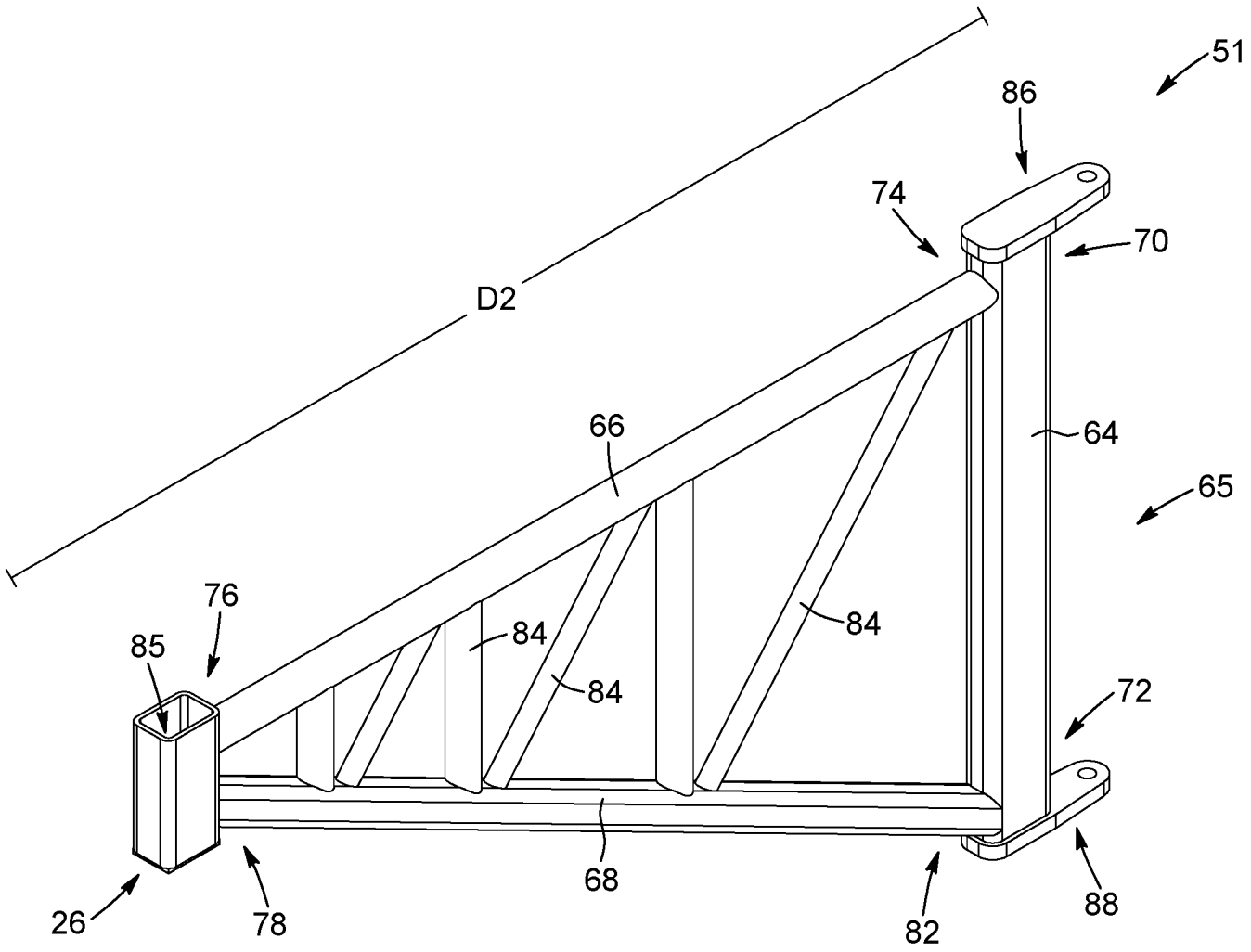
FIG. 4 is a perspective view of a post support truss shown in FIG. 3.
Figure 5:
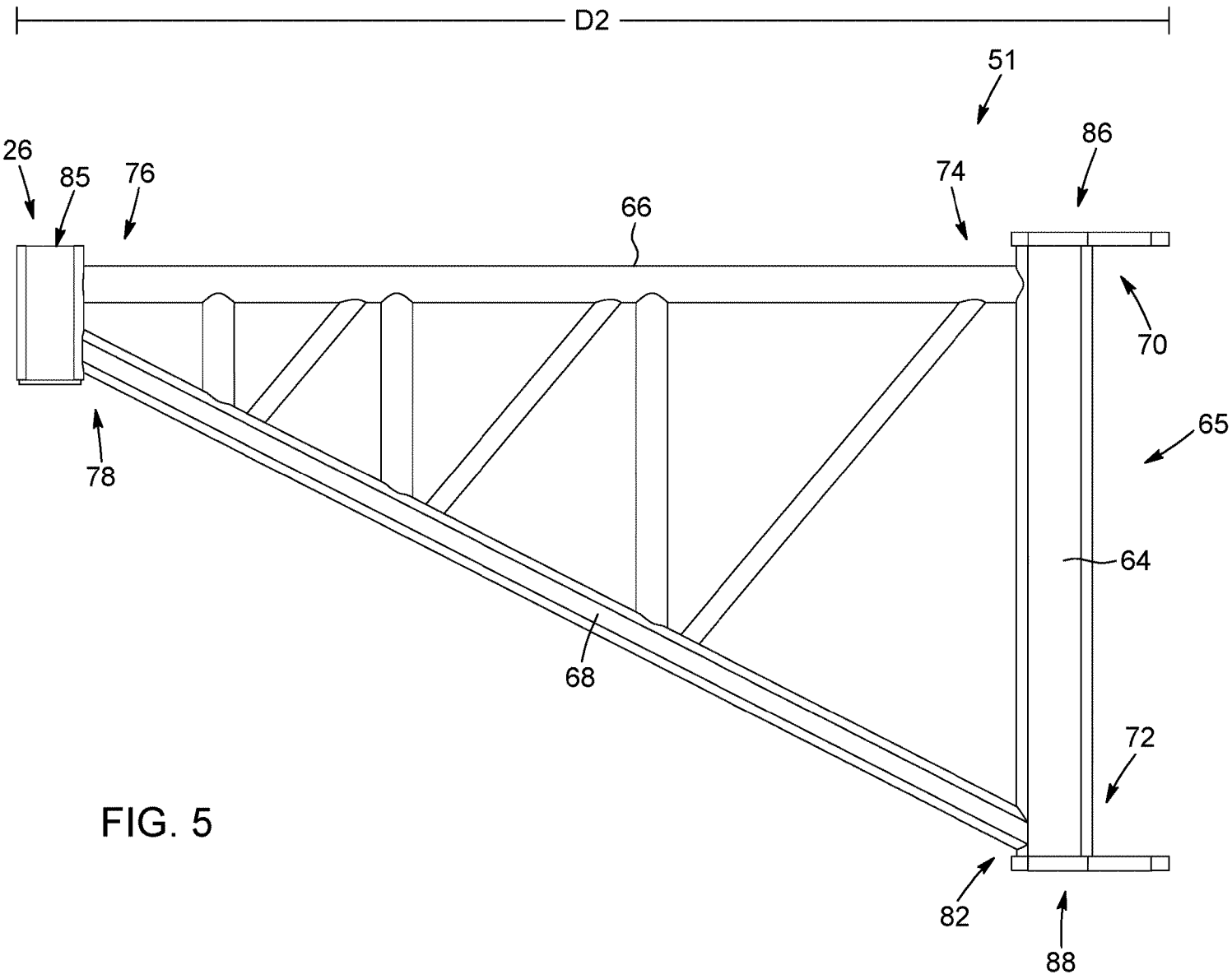
FIG. 5 is a front elevation view of the post support truss shown in FIG. 4.

Now referring to the non-limitative embodiment shown in FIGS. 4 and 5, each post support truss 51 includes a top chord 66 extending substantially normal to the underwater structure 20 or underwater structure surface 22 when mounted thereto, and a bottom chord 68. Each one of the top and bottom chords 66, 68 has an underwater structure end 74, 82, adjacent to the underwater structure 20, and an opposed support post end 76, 78, spaced apart from the underwater structure 20 when mounted thereto.

In the non-limitative embodiment shown, the top chord 66 extends substantially parallel to the water surface 14, while the bottom chord 68 extends diagonally upwardly from the underwater structure end 82 to the post support end 78.

At their underwater structure ends 74, 82, the top and bottom chords 66, 68 are connected to one another by an underwater structure link 65. The underwater structure link 65 includes an upper mounting element connector 86, a lower mounting element connector 88, spaced-apart vertically from the upper mounting element connector 86, and a vertically extending post 64, extending between the upper and lower mounting element connectors 86, 88. More particularly, the upper mounting element connector 86 is mounted to and extends from an upper end 70 of the vertically extending post 64, while the lower mounting element connector 88 is mounted to and extends from an opposed lower end 72 of the vertically extending post 64. The upper and lower mounting element connectors 86, 88 are respectively engageable with the upper and lower mounting elements 44, 48. More particularly, in the non-limitative embodiment shown, the upper and lower mounting element connectors 86, 88 are engageable with the post support structure receiving segment 56 of the anchoring bar 44 and the anchoring plate connector 62 protruding from a respective one of the anchoring plates 58.

Each one of the post support trusses 51 is therefore engageable with the upper and lower mounting element 44, 48 once they have been secured to the underwater structure 20. Thus, the upper and lower mounting element connectors 86, 88 are configured to be detachably secured to the upper and lower mounting elements 44, 48. As mentioned above, mechanical fasteners can be used to secure the post support trusses 51 to the anchoring portion 42 and, more particularly, to the upper and lower mounting elements 44, 48.

In the non-limitative embodiment shown, the upper and lower mounting element connectors 86, 88 are pivotally mounted to and engaged with the anchoring portion 42 and, more particularly, to the upper and lower mounting elements 44, 48.

At their support post ends 76, 78, the top and bottom chords 66, 68 are connected to one another by a respective one of the post receiving member 26, with a post receiving channel 85 of the post receiving member 26 extending substantially vertically. Therefore, when the post support trusses 51 are mounted to the underwater structure 20, via the anchoring portion 42, the elongated posts 28 are spaced-apart from the underwater surface 22 by a distance D2 (FIGS. 4 and 5), which substantially corresponds to a length of the top chord 66. The distance D2 should be long enough to provide a sufficient working space for a worker to manoeuvre within the enclosure 13.

Between the underwater structure ends 74, 82 and the support post ends 76, 78, the top and bottom chords 66, 68 are connected to one another by a plurality of spaced-apart web members 84, with some of them extending substantially normal to the top chord 66 and other extending diagonally between the top and bottom chords 66, 68. As it is known in the art, the web members 84 reinforce the post support truss 51 by increasing the rigidity thereof.

Such configuration of the post support trusses 51 allows an easy storage and/or transport of the cofferdam system 10, as post support trusses 51 can easily and conveniently be detached from the anchoring portion 42 and therefore, from the underwater structure 20, and stacked one over the other.

Referring to the non-limitative embodiment of FIGS. 3 to 5, anchoring plate connector 62 (FIG. 3) of lower mounting elements 48 has a spacing 92 defined between two plates 93, 95 which is configured to receive the lower mounting element connectors 88. In the non-limitative embodiment shown, the post support trusses 51 are secured to the upper and lower mounting elements 44, 48 by engaging mechanical fasteners in apertures defined in the anchoring plate connector 62 and the lower mounting element connectors 88 and which are aligned. As it will be described in more details below, anchoring plate connector 62 is therefore configured to allow pivot of post support trusses 51 about pivot axis 90, which extends parallel to vertically extending post 64 once the post support portion 43 is mounted to the underwater structure 20.

Even though a post support truss 51 with a post receiving member 26 are permanently assembled together, a person skilled in the art to which cofferdam system 10 pertains would understand that such parts or components may be provided as separate components and assembled together prior installation of system 10 to underwater structure 20, or alternatively, only at least two of the parts or components forming the post support trusses 51 and the post receiving members 26 may be integrally formed.

Accordingly, in order to provide the substantially dry environment or enclosure 13 illustrated in FIG. 2, the cofferdam system 10 needs to be mounted and secured to the underwater structure surface 22 of the underwater structure 20, before water can be pumped out, so that workers can integrate the area. The steps of securing the anchoring portion 42 to the underwater structure 20, releasably mounting the post support portion 43 to the anchoring portion 42, providing the web support frame 37 formed by the plurality of posts 38, 40 in the spaced apart configuration with the underwater structure 20, and mounting the substantially flexible impermeable web 33 externally to the post support and anchoring assembly 24 can therefore be performed by a skilled diver, as this whole process is performed underwater. Thus, during installation of the cofferdam system 10 underwater, the elongated anchoring bars 44 are secured to the underwater structure surface 22 of the structure 20 at a predetermined level. It is to be noted that such level can be found to be under the water surface 14 (in the case where the surface to be reached is substantially deep) or alternatively, above the water surface 14 (in the case where the surface to be reached is substantially near the water surface 14). As mentioned above, the elongated anchoring bars 44 are installed one adjacent the other (or alternatively only one anchoring bar can be installed), following a longitudinal axis which is substantially parallel to the water surface 14. The anchoring plates 58 are secured to the underwater structure surface 22 of the underwater structure 20 at a predetermined distance D1 from the elongated anchoring bars 44, which is found to be below the level of the elongated anchoring bars 44 defined above. Anchoring plates 58 are positioned at a level which is underneath the water surface 14, such that the underwater structure 20 can be reached. As mentioned above, the anchoring plates 58 are spaced apart, following a longitudinal axis which is substantially parallel to the water surface 14. The distance D1 defined between the elongated anchoring bars 44 and the anchoring plates 58 substantially corresponds to the length of the vertically extending post 64 of the post support truss 51. To install one of the post support trusses 51, the lower mounting element connector 88 is releasably connected with the anchoring plate connector 62 of the corresponding anchoring plate 58 (i.e., the lower mounting element connector 88 is introduced within the spacing 92). The upper mounting element connector 86 is then moved towards the elongated anchoring bar 44 so that it can be mounted to the post support structure receiving segment 56 using suitable mechanical fasteners or connectors using the openings defined therein. According to the depth under the water surface 14 at which cofferdam system 10 is positioned (or to the depth under the water surface 14 at which the lower mounting members 48 are positioned), distance between each one of the post support trusses 51 can be less or more. Indeed, a system 10 that is found to be deeply positioned under water surface 14 will need to support more pressure from the body of water 12 than a system 10 that is found to be less deeply positioned under the water surface 14. Accordingly, when the lower mounting elements 48 are deeply mounted to the underwater structure 20 under the water surface 14, distance between two adjacent lower mounting elements 48 will be less than if the lower mounting elements 48 are less deeply positioned under the water surface 14 (when pressure increases, more posts 28, 38 are required to support flexible impermeable web 33 being pushed towards dam downstream side 16 by the body of water 12 coming from the dam upstream side 18). The system 10 allows such maneuverability in positioning the lower mounting elements 48 as the elongated anchoring bars 44 are provided with a plurality of spaced apart post support portion receiving apertures 50 on the post support structure receiving segment 56, allowing each one of the lower mounting elements 48 to be positioned and anchored to the underwater structure surface 22 at a desired location, as long as the spacing 92 which is found on the anchoring plate connector 62 is in a substantial vertical alignment with a corresponding one of the post support portion receiving apertures 50 found on the post support structure receiving segment 56 of the elongated anchoring bar 44. Accordingly, when mounted and anchored using suitable mechanical fasteners or connectors, the post support truss 51 will remain in a substantially vertical orientation relatively to the water surface 14. As mentioned above, each post support truss 51, before being secured to the elongated anchoring bar 44 and the corresponding lower mounting element 48 using the suitable mechanical fasteners or connectors, can pivot with respect to the pivot axis 90 (at least once the lower mounting element connector 88 is introduced within the spacing 92), such as to allow different configurations or positionings of the post support trusses 51 relatively to the anchoring portion 42 and therefore, to the underwater structure surface 22.

Once upper mounting elements or elongated anchoring bars 44, lower mounting elements 48 and post support trusses 51 are well secured to the underwater structure 20, the elongated support posts 28 can be provided within the post receiving channels 85 of the post receiving members 26 provided at support post ends 76, 78 and secured therein, such that the elongated support posts 28 can be oriented substantially perpendicular to the water surface 14 and in the spaced apart configuration relatively to the underwater structure 20. The elongated support posts 40 can then be secured substantially perpendicularly to the plurality of spaced apart vertically oriented elongated support posts 28. Additional elongated support posts 38 can further be provided such that a wall made of posts can be provided on all faces of the enclosure 13 (so as to complete the web support frame 37). A layer made of a meshed material can optionally be mounted over or secured externally to the web support frame 37 so as to be positioned inbetween the grid configuration formed by the elongated support posts 28, 38, 40 and the substantially flexible impermeable web 33. The substantially flexible impermeable web 33 can then be positioned across the waterway 12 and mounted or secured externally to the post support and anchoring assembly 24 and the web support frame 37 so as to cover the post support and anchoring assembly 24 as well as at least a lower portion of the web support frame 37 (i.e., the posts 28, 38, 40) from the dam upstream side 18. As a result, water can be removed, using pumps for example, from the dam downstream side 16, to provide the substantially dry environment 13 from the dam upstream side 18 between the substantially flexible impermeable web 33 and the underwater structure surface 22 of the underwater structure 20. A set of flooring elements (not shown) can also be provided over the post support portion 43, and can be supported by the post support trusses 51 for example, for allowing workers to walk thereon. Indeed, each one of the flooring elements can be supported by two or more of the post support trusses 51.

It is noted that a person skilled in the art to which cofferdam system 10 pertains would understand that post support and anchoring assembly 24 can take any shape, size and/or configuration, as long as it provides to position a web support frame (a plurality of elongated support posts 28 for example) spaced apart from the underwater structure 20, while providing a working surface to workers (e.g., flooring elements can be supported by the post support trusses 51 to provide a substantially flat working surface 80 for the worker to perform their tasks in the enclosure 13), so as to provide a safe substantially dry environment when water is removed, or pumped out, from the dam downstream side 16 of the waterway 12. Additionally, the post receiving channel 85 of each one of the post receiving members 26 can define any shape, size, and/or configuration, as long as it can quickly (even though such operation is performed underwater), safely and releasably secure the posts 28 of the web support frame 37 therein. It is to be noted that instead of providing the post receiving members 26 with a post receiving channel 85 to receive a bottom end of a post 28 therein, a clipping mechanism or any other suitable mechanism can be provided at support post ends 76, 78 to fix the web support frame 37 or the posts 28 on the post support trusses 51 so that the web support frame 37 can be positioned substantially perpendicularly with respect to the water surface 14 and in the spaced apart configuration from the underwater structure 20.

Figure 6:
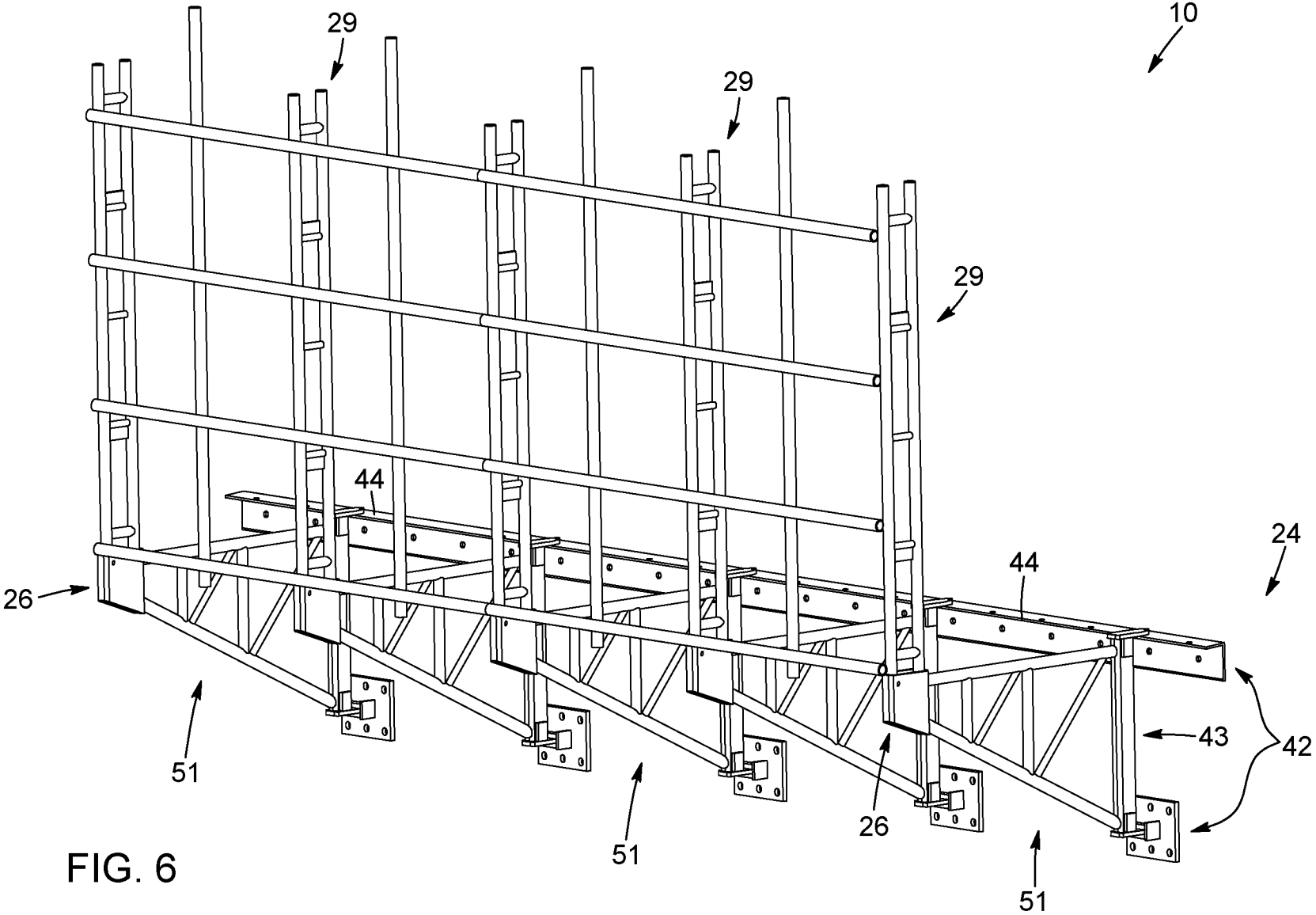
FIG. 6 is a top perspective view of a cofferdam system which is anchored or secured to an underwater structure in accordance with another embodiment.

As best shown in the non-limitative embodiment of FIG. 6, in one scenario, each one of the post receiving channel 85 defined by the post receiving members 26 can even be configured such that a double post 29 can be secured therein, improving rigidity and stability of the web support frame 37 and therefore, of the cofferdam system 10, when it needs to be positioned at important depths from the water surface 14. Each one of the post receiving members 26 can therefore be provided with two distinct post receiving channels or alternatively, one larger post receiving channel, that can accommodate the bottom end of a double post 29. Additional elongated vertical posts 38 can also be provided so as to extend from the elongated horizontal posts 40, once the elongated horizontal posts 40 have been perpendicularly secured to the double posts 29.

It is noted that the upper mounting elements or elongated anchoring bars 44, the lower mounting elements 48, the post support trusses 51, and the posts 28, 38 and 40 can be made of steel but could be made of any suitable material.

Figure 7:
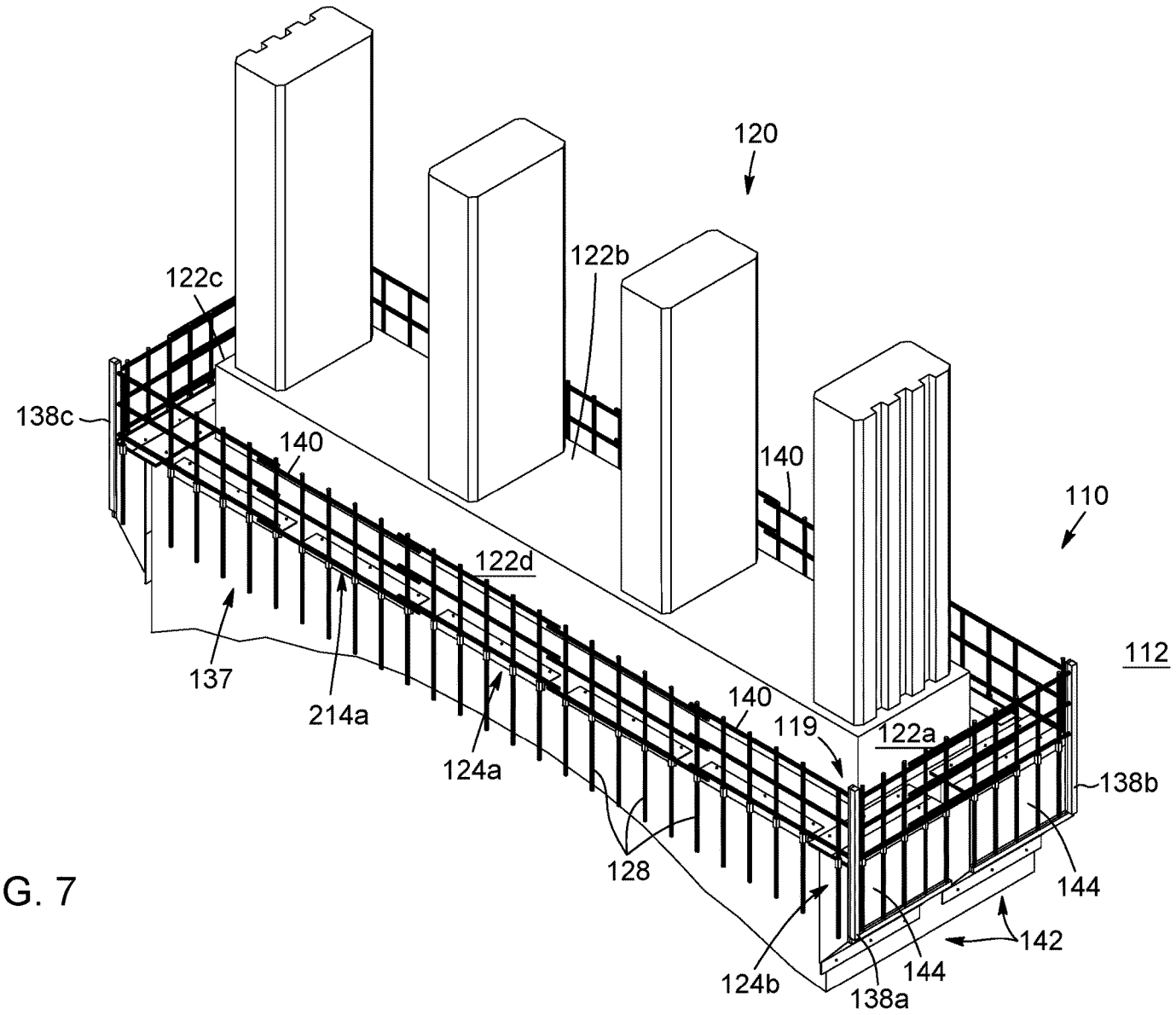
FIG. 7 is a top perspective view of a cofferdam system which is anchored or secured to an underwater structure in accordance with a further embodiment.
Figure 8:
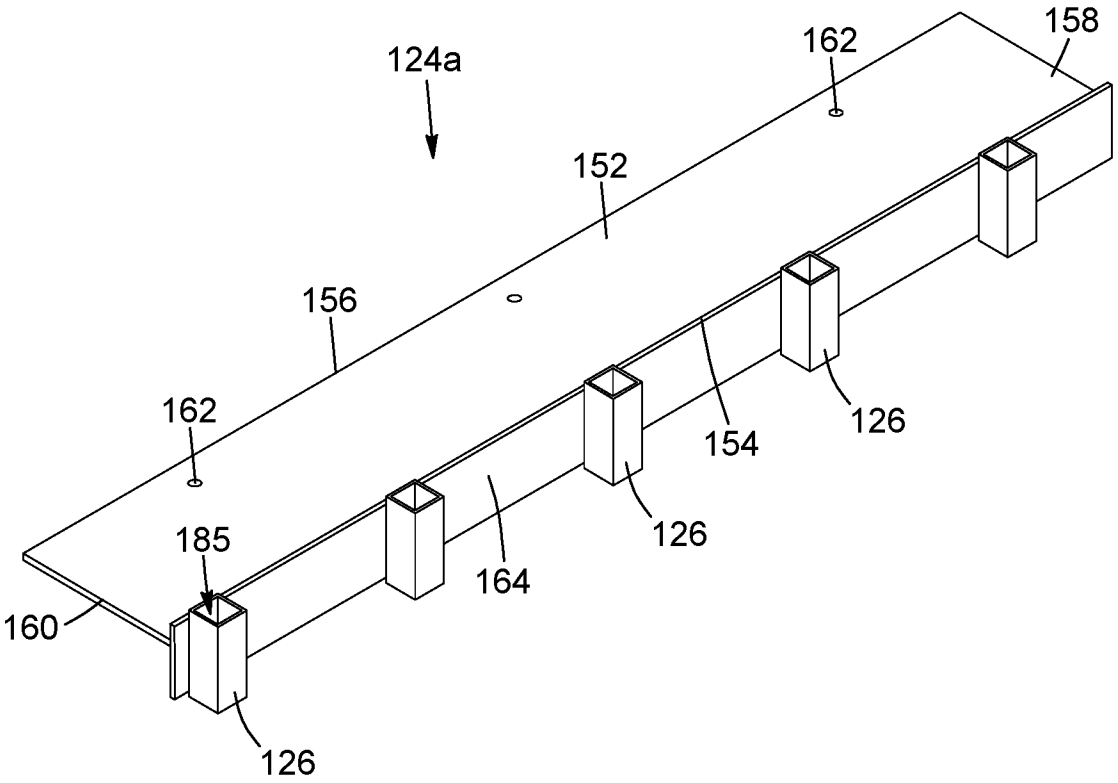
FIG. 8 is a perspective view of a post support member shown in FIG. 7.
Figure 9:
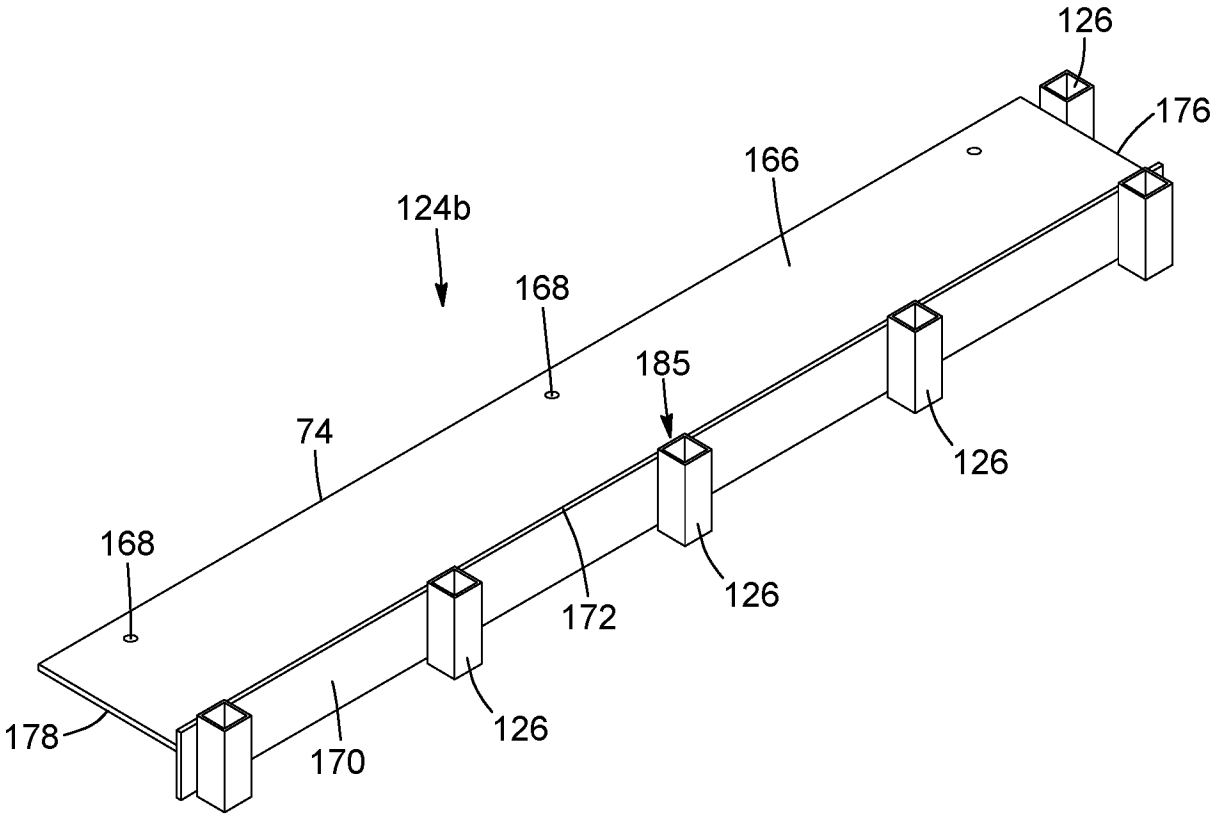
FIG. 9 is a perspective view of another post support member shown in FIG. 7.

Referring now to the non-limitative embodiment shown in FIGS. 7 to 9, there is provided a cofferdam system 110. Cofferdam system 110 is secured to an underwater structure 120, which defines underwater structure surfaces 122*a*, 122*b*, 122*c*, 122*d*. The cofferdam system 110 includes a post support and anchoring assembly 119 which is secured to the underwater structure 120. The system 110 further includes a web support frame 137 which extends partially upwardly from the post support and anchoring assembly 119 in a spaced apart configuration from the underwater structure surfaces 122*a*, 122*b*, 122*c*, 122*d*. The system 110 further includes a substantially flexible impermeable web (such as web 33 shown in FIG. 2) which is positioned across the body of water and which is adapted to cover the post support and anchoring assembly 119 and at least a lower section of the web support frame 137 outwardly therefrom, so as to provide a substantially dry enclosure from the dam upstream side between the substantially flexible impermeable web and the underwater structure 120 when mounted thereto and once water is being removed from the dam downstream side.

Still referring to the non-limitative embodiment shown in FIGS. 7 to 9, the post support and anchoring assembly 119 comprises an anchoring portion 142 which is secured to the underwater structure 120 and a post support portion (comprising post support members 124*a* or 124*b*), which is releasably mounted to the anchoring portion 142 for supporting the web support frame 137.

Indeed, still referring to the non-limitative embodiment shown in FIGS. 7 to 9, the post support portion comprises the plurality of post support members 124*a*, 124*b*. Each post support members 124*a*, 124*b* includes a plurality of spaced apart post receiving members 126 for securing the web support frame 137 thereto in the spaced apart configuration from the underwater structure surfaces 122*a*, 122*b*, 122*c*, 122*d*.

Still referring to the non-limitative embodiment shown in FIGS. 7 to 9, the web support frame 137 comprises a set of vertically oriented elongated support posts 128. Each vertically oriented elongated support post 128 is being releasably securable to a respective one of the plurality of spaced apart post receiving members 126. The web support frame 137 further includes a set of horizontally oriented elongated support posts 140. Each horizontally oriented elongated support post 140 extends perpendicularly from the vertically oriented elongated support posts 128, so as to form a grid configuration to support the flexible impermeable web from the dam upstream side as water applies pressure towards the flexible impermeable web. As illustrated, each post receiving member 126 defines a post receiving channel 185 which extends substantially vertically to receive a respective vertically oriented elongated support post 128 therein.

Still referring to the non-limitative embodiment shown in FIGS. 7 to 9, anchoring portion 142 includes a plurality of main anchoring members 144 mounted and secured to the underwater structure 120, as well as elongated supporting posts (138*a*, 138*b*, 138*c*), which are supported by the main anchoring members 144.

Referring now more particularly to the non-limitative embodiment shown in FIG. 8, there is provided a post support portion 124*a* which is configured to be releasably mounted to the anchoring portion 142 (or directly to the web support frame 137) and for supporting the web frame support frame 137. The post support member 124*a* comprises a main elongated plate 152 which extends between a first longitudinal edge 154, a second longitudinal edge 156, opposite first longitudinal edge 154, a first side edge 158 and a second side edge 160, opposite first side edge 158. The main elongated plate 152 further includes spaced apart anchoring apertures 162 extending therethrough and along the second longitudinal edge 156 so as it can be releasably secured to an anchoring member 144 using suitable mechanical fasteners or connectors insertable therein. The post support member 124*a* further includes a secondary elongated plate 164 extending perpendicularly from the main elongated plate 152 along the entire length of the first longitudinal edge 154. Each post receiving member 126 vertically extends from the secondary elongated plate 156 about the first longitudinal edge 154 of the main elongated plate 152 such as to releasably receive the vertically oriented posts 128 therein.

Referring now more particularly to the non-limitative embodiment of FIG. 9, post support member 124*b* is configured to be releasably mounted to the anchoring portion 142 and for supporting the web frame support frame 137. The post support structure 124*b* includes a main elongated plate 166 which extends between a first longitudinal edge 172, a second longitudinal edge 174, opposite the first longitudinal edge 172, a first side edge 176 and a second side edge 178, opposite the first side edge 176. The main elongated plate 166 further includes spaced apart anchoring apertures 168 defined therein and along the second longitudinal edge 174 so as it can be releasably secured to the main anchoring member 144 using suitable mechanical fasteners or connectors. The post support structure 124*b* further includes a secondary elongated plate 170 which extends perpendicularly from the main elongated plate 166 at its first longitudinal edge 172. As shown, a plurality of spaced apart post receiving members 126 extends substantially vertically from the secondary elongated plate 170 along the length of the first longitudinal edge 172 of the main elongated plate 166, so as to receive a vertically oriented support post 128 therein. Post support structure 124*b* further includes a post receiving member 126 extending from the first side edge 176 of the main elongated plate 166, so post support structure 124*b* can be used to defined corners within the grid configuration.

According to both post support structures 124*a*, 124*b* as defined above and illustrated in the non-limitative embodiments shown in FIGS. 8 and 9, it is noted that a person skilled in the art to which cofferdam system 110 pertains would understand that it can take different sizes, shapes and/or configurations, as long as it provides positioning the web support frame 137 in a spaced apart configuration from the underwater structure 120, while providing a substantially flat working surface (e.g., surface 80 of FIG. 2) to workers so as to provide a safe substantially dry environment 13 when water is being removed, or pumped out, from the dam downstream side of the waterway. It is further noted that additional platforms can alternatively be positioned on main elongated plates 152, 166 to allow a worker to work safely and properly. Additionally, even if each one of the plurality of spaced apart post receiving members 126 is shown to define a post receiving channel 185 which defines a substantially squared surface area, it is noted that post receiving members 126 can define any shape, size, and/or configuration (not necessarily comprising a channel that receives the post, a clipping mechanism or any other suitable mechanism could work for example), as long as it quickly, safely and releasably secure post 128 therethrough/thereon. For example, steel elements may be welded onto external surface defined by elongated support post 128 once elongated support post 128 is inserted within a corresponding post receiving member 126 such as to retain vertical post 128 at a predetermined level. Other mechanisms or configurations can be used to secure corresponding elongated support posts 128 relatively to post receiving members 126.

Furthermore, according to anchoring portion 142 as defined above, it is to be noted that a person skilled in the art to which cofferdam system 110 pertains would understand that it can take different sizes, shapes and/or configurations, as long as it strongly secures some or all of the post support structures 124*a* and/or 124*b* to structure 120, and further, as long as it positions the web support frame 137 in the spaced apart configuration from the underwater structure 120.

It is noted that the main anchoring members 144 as well as the elongated support posts 138*a*, 138*b*, 138*c* can be made of wood, but can alternatively be made of any suitable material, while post support structures 124*a*, 124*b*, elongated support posts 128, and elongated support posts 140 can be made of steel, but can be made of any other suitable material.

According to their configurations, both temporary cofferdam systems 10, 110 described above allow one, a skilled diver for example, to securely, easily and quickly provide a substantially dry environment or enclosure by securing the cofferdam system 10, 110 to an underwater structure (bridge surface, wall surface, any underwater structure surface, etc.). Therefore, such dry working environment can be provided, even if waterway or watercourse bed is found to be too low for installation of known cofferdam systems, or alternatively, if waterway or watercourse bed is uneven. Both cofferdam systems 10, 110 can provide a safe and dry working environment along underwater structure surfaces, independently of its building specification. Furthermore, both cofferdam systems 10, 110 can be dismantled, and re-used for providing a different dry working environment.

Finally, thanks to the sizes, shapes and configurations of their components, cofferdam systems 10, 110 may be stored and/or transported/shipped from one site to another (components may be stacked one over another so it can reduce the storage space needed).

While some embodiments have been described above and illustrated in the accompanying drawings, it will be evident to those skilled in the art that modifications may be made therein without departing from the essence of this disclosure. Such modifications are considered as possible variants comprised in the scope of the disclosure.

The invention claimed is:

1. A cofferdam system securable above a waterbed to an underwater structure defining an underwater structure surface and across a body of water defining a dam downstream side and a dam upstream side, the cofferdam system comprising:

a post support and anchoring assembly securable to the underwater structure in a spaced apart configuration from the waterbed;

a web support frame extending at least partially upwardly from the post support and anchoring assembly in a spaced apart configuration from the underwater structure surface; and a substantially flexible impermeable web positioned across the body of water and configured to cover the post support and anchoring assembly and at least a lower section of the web support frame outwardly therefrom to provide a substantially dry enclosure from the dam upstream side between the substantially flexible impermeable web and the underwater structure surface when mounted to the underwater structure and once water is being removed from the dam downstream side.

2. The cofferdam system as claimed in claim 1, wherein the post support and anchoring assembly comprises an anchoring portion securable to the underwater structure and a post support portion releasably mounted to the anchoring portion and engageable with the web support frame to support the same.

3. The cofferdam system as claimed in claim 2, wherein the post support portion comprises a plurality of spaced apart post receiving members with the web support frame being securable thereto in the spaced apart configuration from the underwater structure surface.

4. The cofferdam system as claimed in claim 2, wherein the anchoring portion comprises an upper mounting element securable to the underwater structure and engageable with an upper portion of the post support portion to mount the post support portion to the underwater structure and a lower mounting element securable to the underwater structure at a distance from the upper mounting element and engageable with a lower portion of the post support portion to mount the post support portion to the underwater structure.

5. The cofferdam system as claimed in claim 3, wherein the post support portion comprises a plurality of spaced apart post support trusses being releasably securable to the anchoring portion, each one of the post support trusses comprising at least one of the plurality of spaced apart post receiving members with the post receiving members being engageable by the web support frame in the spaced apart configuration from the underwater structure surface.

6. The cofferdam system as claimed in claim 4, wherein the upper mounting element comprises a plurality of aligned elongated anchoring bars, each one of the elongated anchoring bars comprising an anchoring segment superposable to the underwater structure surface and securable to the underwater structure and a post support structure receiving segment extending from the anchoring segment with the post support structure receiving segment being engageable by the upper portion of the post support portion.

7. The cofferdam system as claimed in claim 4, wherein the lower mounting element comprises a plurality of spaced apart anchoring plates superposable to the underwater structure surface and securable to the underwater structure, each one of the anchoring plates having an external surface and comprising an anchoring plate connector protruding therefrom, the bottom portion of the post support portion being releasably securable to the anchoring plate connector.

8. The cofferdam system as claimed in claim 6, wherein each one of the post support trusses comprises an underwater structure link comprising:

an upper mounting element connector releasably engageable with the upper mounting element;

a lower mounting element connector spaced-apart vertically from the upper mounting element connector and releasably engageable with the lower mounting element; and a vertically extending post extending therebetween.

9. The cofferdam system as claimed in claim 8, wherein the upper and lower mounting element connectors are respectively pivotally engageable with the post support structure receiving segment of a respective one of the plurality of aligned elongated anchoring bars and the anchoring plate connector protruding from a respective one of the plurality of spaced apart anchoring plates.

10. The cofferdam system as claimed in claim 3, wherein the web support frame comprises a set of vertically oriented elongated support posts, each one of the vertically oriented elongated support posts being releasably securable to a respective one of the plurality of spaced apart post receiving members.

11. The cofferdam system as claimed in claim 10, wherein the web support frame further comprises a set of horizontally oriented elongated support posts, each one of the horizontally oriented elongated support posts extending perpendicularly from the set of vertically oriented elongated support posts to form a grid configuration to support the flexible impermeable web from the dam upstream side as water applies pressure towards the flexible impermeable web.

12. The cofferdam system as claimed in any one of claim 8, wherein each one of the post support trusses further comprises a top chord and a bottom chord, each one of the top and bottom chords extending from the underwater structure surface when mounted thereto and defining an underwater structure end adjacent to the underwater structure surface and an opposed support post end spaced apart from the underwater structure surface when mounted to the underwater structure.

13. The cofferdam system as claimed in claim 12, wherein the top cord extends substantially normal to the vertically extending post and the bottom chord extends diagonally upwardly from the vertically extending post towards the support post end of the top cord.

14. The cofferdam system as claimed in claim 13, wherein the support post ends of the top and bottom chords are connected to one another by a respective one of the plurality of post receiving members, the post receiving member having a post receiving channel extending substantially vertically therein to receive at least a respective one of the vertically oriented elongated support posts therein.

15. The cofferdam system as claimed in claim 10, wherein the plurality of aligned elongated anchoring bars are securable to the underwater structure in an horizontally adjacent configuration and the plurality of spaced apart anchoring plates are securable to the underwater structure below the plurality of aligned elongated anchoring bars in a configuration substantially parallel to the anchoring bars.

16. The cofferdam system as claimed in claim 10, wherein the anchoring plate connector comprises two plates spaced-apart from one another to define a spacing inbetween to receive the lower mounting element connector therein in a pivotable engagement about a pivot axis extending parallel to the underwater structure link when secured together.

17. A method for forming a substantially dry enclosure above a waterbed, adjacent an underwater structure defining an underwater structure surface and within a body of water defining a dam downstream side and a dam upstream side, the method comprising:

securing a post support and anchoring assembly to the underwater structure in a spaced apart configuration from the waterbed;

providing a web support frame to extend at least partially upwardly from the post support and anchoring assembly in a spaced apart configuration from the underwater structure surface;

positioning a substantially flexible impermeable web across the body of water so as to cover the post support and anchoring assembly and at least a lower section of the web support frame with the substantially flexible impermeable web from the dam upstream side; and pumping water out of the dam downstream side to provide the substantially dry enclosure from the dam upstream side between the substantially flexible impermeable web and the underwater structure.

18. A cofferdam system securable above a waterbed to an underwater structure defining an underwater structure surface and across a body of water defining a dam downstream side and a dam upstream side, the cofferdam system comprising:

a post support and anchoring assembly securable to the underwater structure in a spaced apart configuration from the waterbed, the post support and anchoring assembly comprising an anchoring portion securable to the underwater structure and a post support portion releasably mounted to the anchoring portion and engageable with the web support frame to support the same, wherein the anchoring portion comprises an upper mounting element and a lower mounting element, the upper mounting element being securable to the underwater structure and engageable with an upper portion of the post support portion to mount the post support portion to the underwater structure, the lower mounting element being securable to the underwater structure at a distance from the upper mounting element and engageable with a lower portion of the post support portion to mount the post support portion to the underwater structure;

a web support frame extending at least partially upwardly from the post support and anchoring assembly in a spaced apart configuration from the underwater structure surface; and a substantially flexible impermeable web positioned across the body of water and configured to cover the post support and anchoring assembly and at least a lower section of the web support frame outwardly therefrom to provide a substantially dry enclosure from the dam upstream side between the substantially flexible impermeable web and the underwater structure surface when mounted to the underwater structure and once water is being removed from the dam downstream side.

* * * * *